United States Patent [19]

Gomes

[11] 4,152,788

[45] May 8, 1979

[54] PORTABLE BIDET

[76] Inventor: Antonio Z. F. R. P. Gomes, 107 Bergen St., Harrison, N.J. 07029

[21] Appl. No.: 846,398

[22] Filed: Oct. 28, 1977

[51] Int. Cl.[2] ..... A47K 3/22; A47K 11/08

[52] U.S. Cl. ..... 4/6; 4/7

[58] Field of Search ..... 4/6, 7, 113

[56] References Cited

U.S. PATENT DOCUMENTS

| | | | |
|---|---|---|---|
| 2,251,039 | 7/1941 | Silva | 4/6 |
| 2,427,807 | 9/1947 | Oliver | 4/6 |
| 3,039,117 | 6/1962 | Hoskins | 4/6 |
| 3,072,918 | 1/1963 | McCall et al. | 4/7 |
| 3,102,273 | 9/1963 | McCarthy | 4/6 |
| 3,365,729 | 1/1968 | Perlman | 4/6 |
| 3,484,872 | 12/1969 | Romberger, Jr. | 4/6 |
| 3,541,613 | 11/1970 | Sypal | 4/6 |
| 3,654,636 | 4/1972 | Restyanszki | 4/6 |
| 3,729,748 | 5/1973 | Perlman | 4/6 |
| 3,795,015 | 3/1974 | Talge | 4/6 |

*Primary Examiner*—Henry K. Artis

*Attorney, Agent, or Firm*—Toren, McGeady and Stanger

[57] ABSTRACT

A portable bidet includes a base with a rim around at least a portion of its edge so that it can be supported on a toilet with the basin extending downwardly into the toilet bowl. A hole is provided in the lower portion of the basin for draining the bidet. Preferably, the bidet is molded of a reinforced plastics material though it can be formed of a thin metal. The bidet is shaped for ease in molding and for use with all standard toilets.

12 Claims, 17 Drawing Figures

PORTABLE BIDET

SUMMARY OF THE INVENTION

The present invention is directed to a bidet and, more particularly, it concerns a portable bidet which can be used on a toilet.

A bidet is usually formed of a ceramic material, similar to the material used in forming a toilet and includes considerable installation costs. Further, when installed in a bathroom, a bidet requires considerable space.

In the past it has been known to use a portable vessel for converting a toilet into a bidet. Such portable units are usually adaptable to any type of toilet and permit considerable savings in space and installation costs. These known portable bidets, however, are usually of an involved construction and are relatively heavy which tends to defeat the portable character of the unit. Moreover, many of the known portable bidets involve attached plumbing systems which further complicate their handling and storage in a conventional bathroom.

Therefore, it is a primary object of the present invention to provide a portable bidet which is easy to handle and store and is inexpensive to produce. A further object is to provide a bidet that can be used with all standard types of toilets.

In accordance with the present invention, a portable bidet is provided which is light in weight and easy to handle, does not require any plumbing connection directly to it, and is easy to store.

The portable bidet embodying the present invention is preferably molded from a reinforced plastics material, however, it can be formed of a thin metal or other material compatible for use as a bidet. Basically, the bidet consists of a basin and a rim extending around at least a portion of the basin's edge. The rim extends laterally outwardly from the basin and forms support for the basin on the upper edge of the toilet bowl. A hole is provided in the lower portion of the basin for draining the bidet into the toilet. The hole is provided with a removable closure so that it can be opened or closed as required. The walls or surfaces forming the basin and the rim are arranged for ease in molding the unit and also to facilitate its storage. A simple spray device which does not require an involved plumbing installation can be used with the bidet.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 4:
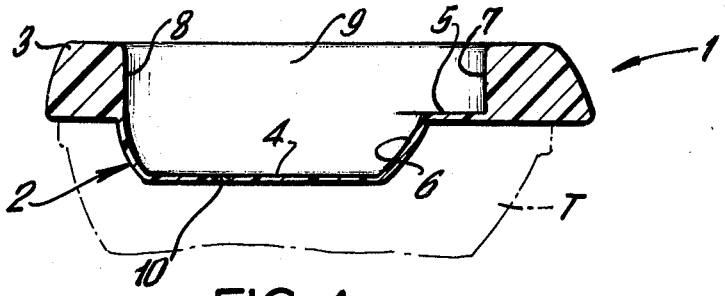
FIG. 4 is a longitudinal sectional view taken along the line IV—IV in FIG. 1.
Figure 5:
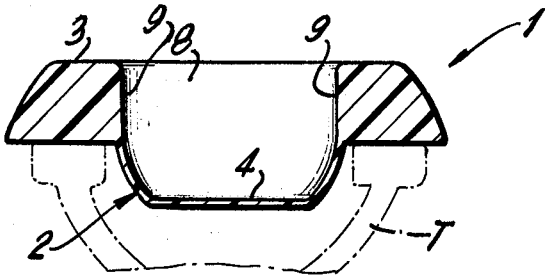
FIG. 5 is a transverse sectional view taken along the line V—V in FIG. 1.

In FIGS. 1-5 a portable bidet 1 is illustrated consisting of a basin 2 with a rim 3 extending around the edge of the basin. As shown in FIGS. 4 and 5 the bidet is shaped to fit on a standard toilet T shown in phantom in FIGS. 4 and 5. Preferably, the bidet 1 is molded of reinforced plastics material so that it is light in weight, has adequate strength, and is easy to handle and store. In addition, it can also be formed by laminating layers of similar materials which are adapted to the specific use for which a bidet is employed. The bidet can also be formed of thin metal sheet.

The basin 2 is formed of a generally horizontal bottom surface 4, an intermediate horizontal surface 5, and a sloping surface 6 extending obliquely to and between the bottom surface 4 and the intermediate surface 5. Joining these three surfaces to the rim is an upwardly extending annular surface consisting of a front surface 7, a rear surface 8 and side surfaces 9 extending between the front and rear surfaces. The front surface is curved as viewed in FIG. 1 and extends vertically as can be seen in FIG. 4. The front surface 7 extends from the upper surface of the rim 3 downwardly to the intermediate surface 5. The rear surface 8 also extends vertically downwardly from the upper surface of the rim 3 to approximately the level of the intermediate surface 5 and then curves inwardly as it proceeds downwardly to its juncture with the bottom surface 4. The side surfaces 9 are shaped similarly to the front surface 7 in the range of the intermediate surface 5, and similarly to the rear surface 8 in the range of the sloping surface 6 and the bottom surface 4.

As shown in FIGS. 4 and 5 the rim 3 is a solid member having a lower surface resting on the toilet and an upper surface forming a seating surface for the bidet. Alternatively, the rim can be a hollow member. The radial dimension of the rim around the front and along the sides of the bidet is quite wide to permit adequate bearing surface on the top of the toilet, however, across the rear side of the bidet the rim is relatively narrow so that it can be supported on the surface of the toilet without interfering with the toilet seat or the hardware attaching it to the toilet.

Positioned in the bottom surface 4 is a drain hole 10 for emptying the basin into the toilet. Though not shown, a plug or similar member can be provided as a closure for the drain hole.

The shape of the basin 2 and rim 3 simplify its formation, preferably by molding, and, further, its shape makes it easy to handle and store in a conventional bathroom.

Figure 6:
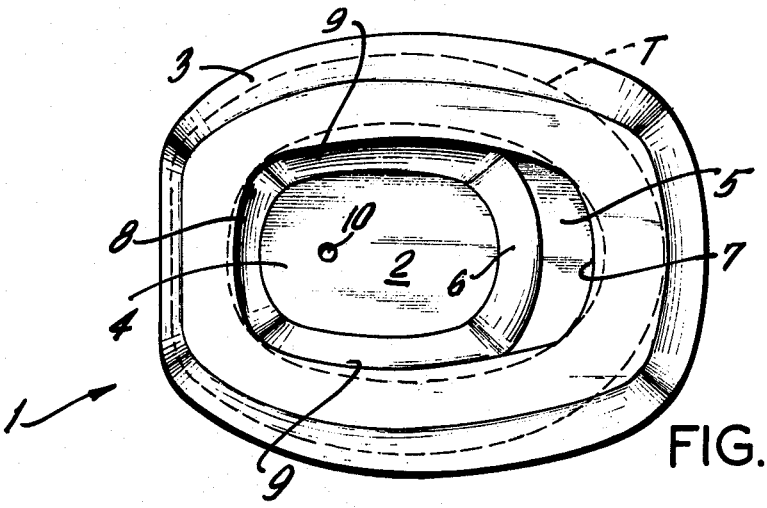
FIG. 6 is a plan view, similar to FIG. 1, representing the bidet mounted on a toilet.
Figure 7:
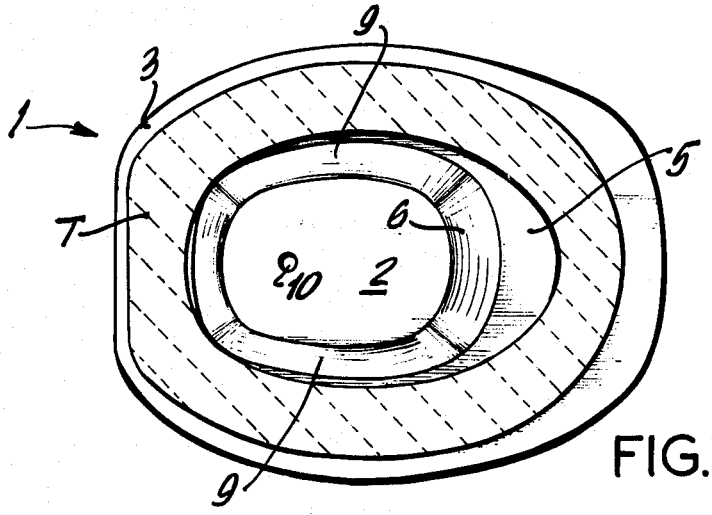
FIG. 7 is a bottom view of FIG. 6 and showing the top of the toilet supporting the undersurface of the bidet.

As can be seen in FIGS. 6 and 7 the bidet is shaped so that it extends laterally outwardly and forwardly of the toilet so that it can function effectively. As can be seen in FIG. 7, the intermediate surface 5 is at about the same level as the top of the toilet and can extend forwardly from the toilet. This arrangement facilitates the use of the bidet with smaller sized toilets. The relation between the bidet 1 and the toilet T can be seen in FIG. 7 where the rim and the forward part of the basin project outwardly from the toilet.

Figure 1:
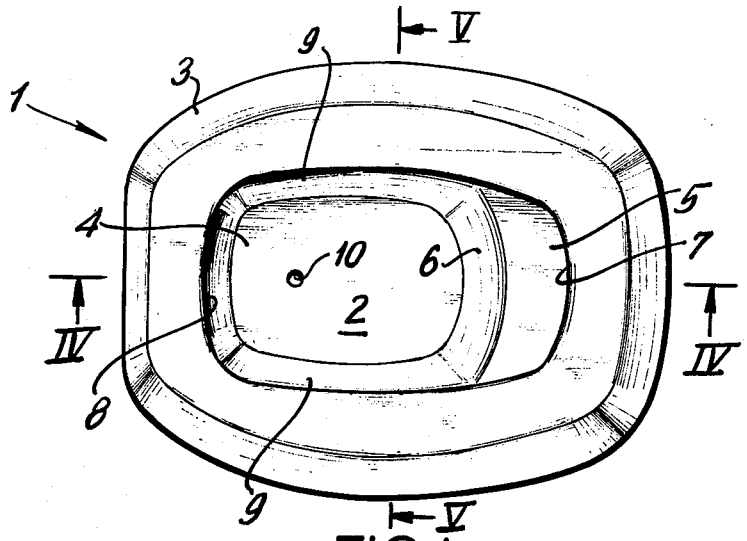
FIG. 1 is a plan view of a portable bidet embodying the present invention.
Figure 2:
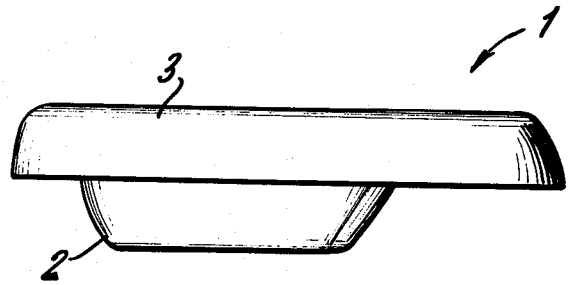
FIG. 2 is a longitudinal side view of the bidet.
Figure 3:
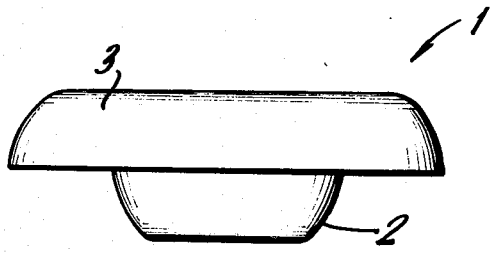
FIG. 3 is an end view of the bidet.
Figure 8:
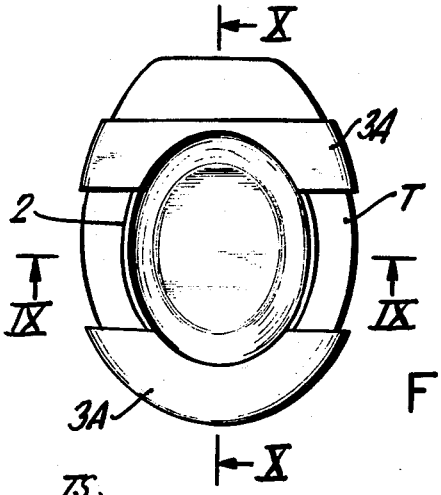
FIG. 8 is a plan view of another configuration of a bidet embodying the present invention.
Figure 9:
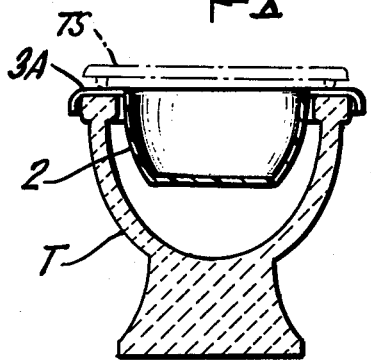
FIG. 9 is a transverse sectional view taken along the line IX—IX in FIG. 8.
Figure 10:
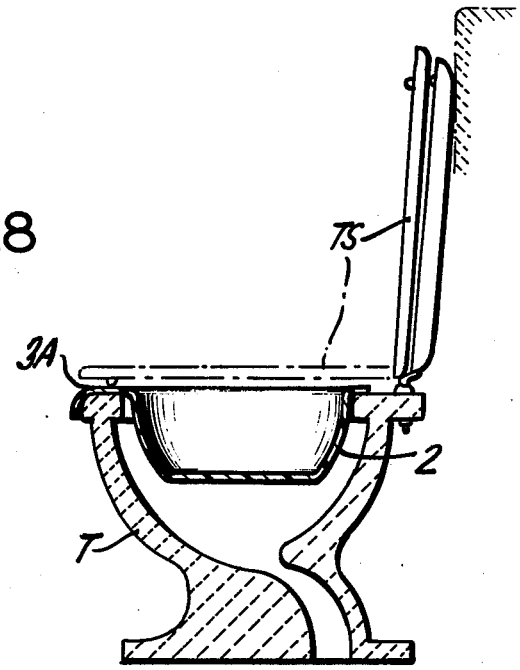
FIG. 10 is a longitudinal sectional view taken along the line X—X in FIG. 8.

In the embodiment shown in FIGS. 8, 9 and 10, the basin 2 of the bidet is shown only schematically and the rim 3A is not continuous as in FIG. 1 but is provided only across the front of the basin and laterally at its rearward portion. By limiting the rim, the weight of the bidet can be considerably reduced so that its portability is enhanced and it can be more easily handled and stored.

FIGS. 9 and 10 show the position of the bidet relative to the toilet seat TS which is shown in dashed lines in the normal seated position and in full lines lifted upwardly from the top of the toilet. It can be noted in these Figures that the bidet is easily supported on the top of the toilet so that adequate support is available without any possibility of the bidet being displaced.

Figure 11:
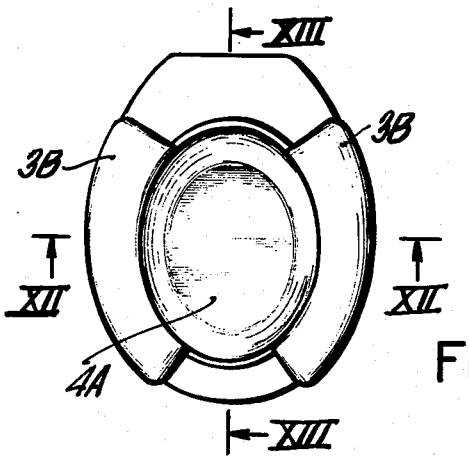
FIGS. 11, 12 and 13 are views similar to FIGS. 8, 9 and 10, respectively, illustrating another embodiment of the invention.
Figure 12:
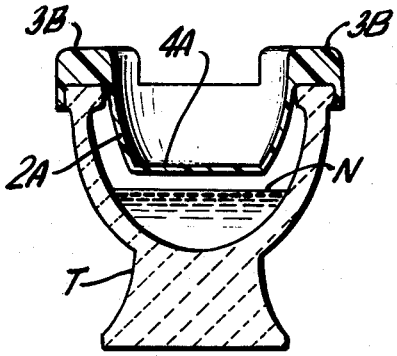
Figure 13:
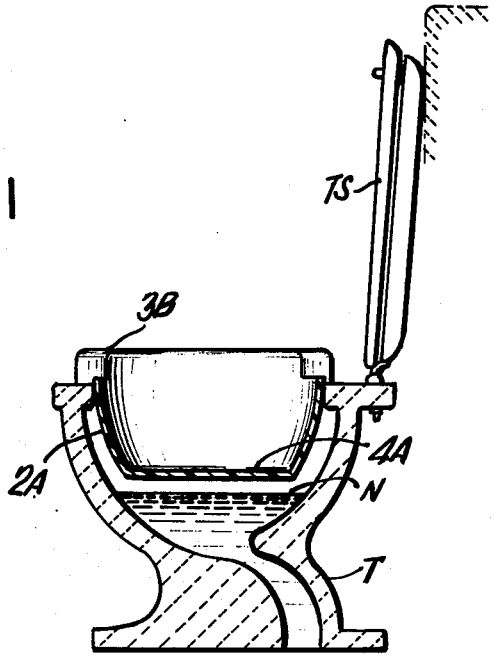

In FIGS. 11, 12 and 13 another schematic arrangement of the bidet is shown with the rim 3B extending laterally along the opposite sides of the basin, without any rim being provided at either its front or rear edges. With this arrangement the seating surface provided by the top surface of the rim is elevated above the top of the toilet for facilitating the use of the bidet. As can be seen in this schematic showing, the basin 2A has a somewhat oval shape with its bottom surface 4A being horizontal and its sides extending vertically downwardly from the rim 3B and curving inwardly into the bottom surface. Though not shown, a drain outlet would be provided in the bottom surface of the bidet.

As shown in the various Figures, there are no passageways or openings in the portable bidet to provide a source of water or a spray. This arrangement considerably simplifies the bidet both from the viewpoint of its manufacturing costs and its portability.

Figure 14:
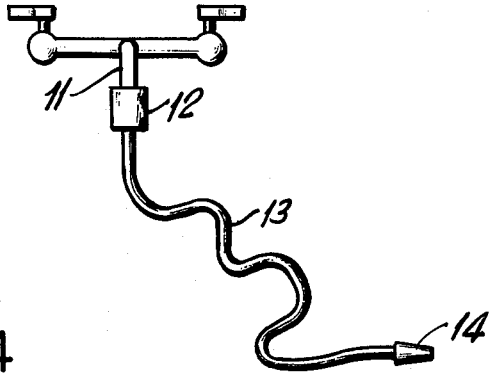
FIG. 14 is a schematic illustration of a spray usable with the portable bidet.
Figure 15:
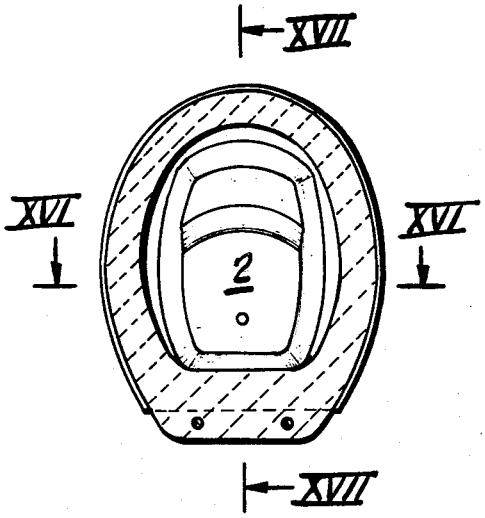
FIG. 15 is a bottom view of a bidet embodying the present invention supported on a toilet.

As indicated in FIG. 14, a separate spray member can be included with the bidet for connection to the hot and cold water taps in the bathroom. The spray member includes an adapter 12 to be fitted to the water outlet 11 supplying both hot and cold water into a basin or a tub. A flexible hose 13 extends from the adapter to an irrigating showerhead 14 permitting a supply of water to be directed into the bidet.

The bidet can be equipped with a removable cover and the cover can be provided with a mirror for decorative as well as for functional purposes. A hole or other means can be provided in the rim or other portions of the bidet so that it can be hung or supported on a wall in the storage position.

While the walls of the bidet have been shown as solid, that is, with the exception of the possibility of a hollow rim, the walls of the basis could be hollowed out for conveying water.

Figure 16:
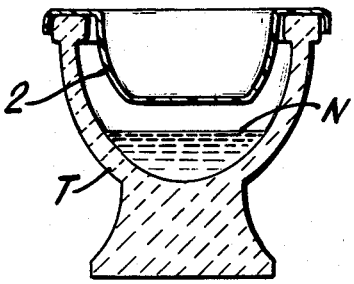
FIG. 16 is a transverse sectional view taken along the line XVI—XVI in FIG. 15.
Figure 17:
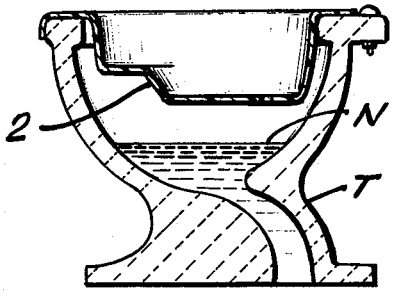
FIG. 17 is a longitudinal sectional view taken along the line XVII—XVII in FIG. 15.

While the intermediate surface 5 has been described as substantially horizontal, it will be appreciated that this surface is provided with a slight slope toward the sloping surface 6 for draining any water into the bottom of the bidet where it can be discharged into the toilet through the drain opening 10. In FIGS. 12 and 13 along with FIGS. 16 and 17, the water level N in the toilet is indicated spaced considerably below the lower surface of the bidet.

While specific embodiments of the invention have been shown and described in detail to illustrate the application of the inventive principles, it will be understood that the invention may be embodied otherwise without departing from such principles.

What is claimed is:

1. A portable bidet for use on a toilet comprising a basin shaped to fit within the bowl of the toilet and having a peripheral edge, said peripheral edge consisting of a forward edge, a rearward edge and a pair of oppositely spaced side edges extending between said forward and rearward edges with said forward edge arranged to be positioned adjacent the front edge of the toilet bowl and the rearward edge arranged to be positioned adjacent the rear edge of the toilet bowl, a rim member secured to the peripheral edge of said basin and extending laterally outwardly from said edge, said rim member having an upwardly facing surface and a downwardly facing surface with said downwardly facing surface arranged to be supported on the upper surface of the toilet surrounding its bowl and said upwardly facing surface of said rim forming a seating surface on the bidet, said basin depending downwardly from the downwardly facing surface of said rim so that the basin extends downwardly into the toilet bowl, said basin having an outlet opening therein with the remainder of said basin being imperforate, said basin having an upwardly facing surface comprising a generally horizontally extending first surface spaced downwardly from said upwardly facing surface of said rim member and located adjacent the forward edge of said basin, a general horizontally extending second surface spaced downwardly from said first surface and spaced between said first surface and the rearward edge of said basin, an upwardly extending third surface joined at its lower edge to said second surface and at its upper edge to said first surface and being disposed obliquely to said first and second surfaces with said third surface sloping downwardly rearwardly from said first surface to said second surface.

2. A portable bidet, as set forth in claim 1, wherein an upwardly extending fourth surface extends around and laterally encloses said first, second and third surfaces and extends downwardly from the inner edge of the upwardly facing surface of said rim to the outer edges of said first, second and third surfaces.

3. A portable bidet, as set forth in claim 2, wherein said fourth surface extends substantially vertically in the range between said rim and the level of said first surface and below said first surface curves inwardly into contact with the edges of said second and third surfaces.

4. A portable bidet, as set forth in claim 1, wherein said upwardly and downwardly facing surfaces of said rim member being vertically spaced apart and said rim comprising a solid wall section extending between said upwardly and downwardly facing surfaces.

5. A portable bidet, as set forth in claim 1, wherein said upwardly and downwardly facing surfaces of said rim member being vertically spaced apart and said rim comprising a hollow wall section extending between said upwardly and downwardly facing surfaces.

6. A portable bidet, as set forth in claim 1, wherein said outlet opening being spaced radially inwardly from the junction of said second surface with said third and fourth surfaces.

7. A portable bidet, as set forth in claim 1, wherein said rim member being annular and extending completely around the edge of said basin.

8. A portable bidet, as set forth in claim 1, wherein said rim having a downwardly extending flange extending around the radially outer edge thereof along the forward and side edges of said basin.

9. A portable bidet, as set forth in claim 8, wherein said rim extending along the rearward edge of said basin being a narrow lip for preventing interference with the toilet seat and the means attaching the toilet seat to the toilet.

10. A portable bidet, as set forth in claim 1, wherein a removable cover fits over and forms a closure for the upper end of said basin.

11. A portable bidet, as set forth in claim 1, wherein an opening is formed in said rim so that said bidet can be hung on a nail or the like by fitting the nail into the opening in said rim.

12. A portable bidet, as set forth in claim 1, wherein means formed on said bidet for hanging the bidet in a storage position.

* * * * *